US006556654B1

(12) United States Patent
Hansen et al.

(10) Patent No.: US 6,556,654 B1
(45) Date of Patent: Apr. 29, 2003

(54) HIGH VOLTAGE CABLE AND CLAMP SYSTEM FOR AN X-RAY TUBE

(75) Inventors: Wayne R. Hansen, Centerville, UT (US); John Richardson, Salt Lake City, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 10/036,043

(22) Filed: Nov. 9, 2001

(51) Int. Cl.[7] ..... H05G 1/10; H01R 13/585
(52) U.S. Cl. ..... 378/101; 439/470; 439/611
(58) Field of Search ..... 378/101, 119; 439/449, 459, 462, 470, 473, 610, 611, 271, 258

(56) References Cited

U.S. PATENT DOCUMENTS

| | | | | |
|---|---|---|---|---|
| 4,335,928 A | | 6/1982 | Barrett et al. | 439/271 |
| 4,362,348 A | | 12/1982 | Stephenson et al. | 439/258 |
| 4,494,811 A | | 1/1985 | Palermo, Jr. | 439/271 |
| 4,767,961 A | | 8/1988 | Koller et al. | 313/12 |
| 5,145,402 A | * | 9/1992 | Plyler et al. | 439/459 |
| 5,154,638 A | | 10/1992 | Sireul et al. | 439/611 |
| 5,162,267 A | | 11/1992 | Smyth | 501/45 |
| 5,310,361 A | | 5/1994 | Muchowicz et al. | 439/610 |
| 5,358,419 A | | 10/1994 | Pejsa et al. | 439/201 |
| 5,384,820 A | | 1/1995 | Burke | 378/135 |
| 5,553,114 A | | 9/1996 | Siemers et al. | 378/129 |
| 5,707,252 A | | 1/1998 | Meszaros | 439/610 |
| 6,140,582 A | * | 10/2000 | Sheehan | 439/584 |
| 6,198,802 B1 | * | 3/2001 | Elliot et al. | 378/101 |
| 6,213,805 B1 | | 4/2001 | Jedlitschka et al. | 439/271 |

* cited by examiner

*Primary Examiner*—Drew A. Dunn
(74) *Attorney, Agent, or Firm*—Workman, Nydegger & Seeley

(57) ABSTRACT

A system for securely maintaining a high voltage cable within an electrical device, such as an x-ray tube, is disclosed. The system is useful for ensuring a close fit between an x-ray tube cathode insulator and the high voltage cable assembly disposed therein, thereby reducing the chances for damaging electrical arcing to occur. A high voltage cable assembly and clamp body generally comprise the system. The high voltage cable comprises two sections disposed at a right angle with respect to one another. One section defines a cavity for receiving a plunger/spring assembly housed within the clamp body. The plunger/spring assembly compresses and expands in response to the thermal expansion and contraction of the high voltage cable assembly during tube operation. A calibration window and adjustment screws are provided with the clamp body to enable a technician to readily determine and adjust the level of compressive force imparted by the system.

26 Claims, 12 Drawing Sheets

HIGH VOLTAGE CABLE AND CLAMP SYSTEM FOR AN X-RAY TUBE

BACKGROUND OF THE INVENTION

1. The Field of the Invention

The present invention generally relates to high voltage devices. More particularly, the present invention relates to a system for securing a high voltage cable within an x-ray tube.

2. The Related Technology

X-ray generating devices are extremely valuable tools that are used in a wide variety of applications, both industrial and medical. For example, such equipment is commonly employed in areas such as medical diagnostic examination, therapeutic radiology, semiconductor fabrication, and materials analysis.

Regardless of the applications in which they are employed, most x-ray generating devices operate in a similar fashion. X-rays are produced in such devices when electrons are emitted, accelerated, then impinged upon a material of a particular composition. This process typically takes place within an x-ray tube located in the x-ray generating device. The x-ray tube generally comprises a vacuum enclosure, a cathode, and an anode. The cathode generally comprises a metallic cathode head and a cathode cup disposed thereon. A rectangular slot formed in the cathode cup typically houses a filament that, when heated via an electrical current, emits a stream of electrons. The cathode is disposed within the vacuum enclosure, as is the anode, which is oriented to receive the electrons emitted by the cathode. The anode, which typically comprises a graphite substrate upon which is disposed a heavy metallic target surface, can be stationary within the vacuum enclosure, or can be rotatably supported by a rotor shaft and a rotor assembly. The rotary anode is typically spun using a stator that is circumferentially disposed about the rotor assembly, and is disposed outside of the vacuum enclosure. The vacuum enclosure may be composed of metal (such as copper), glass, ceramic material, or a combination thereof, and is typically disposed within an outer housing.

In operation, an electric current is supplied to the cathode filament of the x-ray tube, causing it to emit a stream of electrons by thermionic emission. A high voltage potential placed between the cathode and the anode causes the electrons in the electron stream to gain kinetic energy and accelerate toward the target surface located on the anode. Upon striking the target surface, many of the electrons convert their kinetic energy into electromagnetic radiation of very high frequency, i.e., x-rays. The specific frequency of the x-rays produced depends in large part on the type of material used to form the anode target surface. Target surface materials having high atomic numbers ("Z numbers"), such as tungsten carbide or TZM (an alloy of titanium, zirconium, and molybdenum) are typically employed. The beam of x-rays produced by the electrons then passes through windows defined in the vacuum enclosure and outer housing. Finally, the x-ray beam is directed to the x-ray subject to be analyzed, such as a medical patient or a material sample.

Several types of x-ray tubes are commonly known in the art. Double-ended x-ray tubes electrically bias both the cathode and the anode with a high negative and high positive voltage, respectively. The voltage applied to the cathode and anode may reach +/−75 kilovolts ("kV") or higher during the operation of a double-ended tube. In contrast, single-ended x-ray tubes electrically bias only the cathode, while maintaining the anode at the housing or ground potential. In such tubes, the cathode may be biased with a voltage of −150 kV or more during tube operation. In either case, a sufficient differential voltage is established between the anode and the cathode to enable electrons produced by the cathode filament to accelerate toward the target surface of the anode.

The high voltage applied to the anode and/or cathode is typically supplied via a high-voltage cable. The high-voltage cable typically comprises a plurality of conductive wires protectively covered by an outer covering. In a single-ended tube, one end of the high-voltage cable is attached at one end to an electric power supply, while the other end is typically inserted into a plug connector sufficient to provide the high voltages needed for x-ray tube operation. The plug connector comprises an outer covering and has electrical contacts disposed at one end for electrically connecting the conductive wires of the high voltage cable to the cathode.

Because of the high voltage present in the x-ray tube during operation, the use of insulating structures supportably connecting the anode and/or cathode to the vacuum enclosure or outer housing is necessary to electrically isolate them from the rest of the tube. These insulating structures are typically composed of an electrically insulative material, such as glass or ceramic, and may comprise a variety of shapes. Regardless of their shape however, the insulating structures must accommodate the reduction in voltage from the high voltage present at the anode and/or cathode to the much lower housing or ground potential typically present at the surface of the vacuum enclosure.

In typical x-ray tubes, a cathode insulating structure comprises a hollow conical shape and is composed of an insulating material such as glass or ceramic. The cathode insulating structure attaches at one end to the housing or vacuum enclosure of the x-ray tube and at the other end to the cathode, which it supports in a position proximate the target surface of the anode as described above. In order to supply the high voltage potential to the cathode, the plug connector of the high-voltage cable is typically disposed within the inner volume defined by the conical cathode insulating structure, where it electrically connects to the cathode. The inner surface of the conical cathode insulating structure defines a frustoconical shape. The outer surface of the plug connector of the high-voltage cable that is disposed within the cathode insulating structure also comprises a frustoconical shape near the end that electrically connects with the cathode. This shape is necessary so as to allow the outer surface of the plug connector to complementarily fit against the inner surface of the cathode insulating structure.

A physically close fit between the outer surface of the plug connector and the inner surface of the cathode insulating structure is necessary in order to avoid electric arcing between the surfaces. If a space develops between the plug connector outer surface and the cathode insulating structure inner surface during tube operation, dangerous electrical arcing may occur, which can damage the highly sensitive components contained within the x-ray tube.

In order to avoid problems associated with electrical arcing between the cathode insulating structure and the high-voltage cable, various assemblies have been used in the past to ensure a tight fit between these two components. For instance, cable clamps have been utilized to secure the high-voltage cable within the inner volume of the cathode insulator. Unfortunately, such clamps have suffered from various setbacks. For instance, it is extremely difficult to ascertain the amount of force that such clamps apply to the high-voltage cable disposed within the cathode insulating structure. If too much force is applied, undue stress is inflicted upon the cathode insulating structure and the high-voltage cable, which may reduce the operating lifetime of one or both of the components. Too little force, on the other hand, opens up the possibility for electrical arcing to occur between the insulating structure and the high-voltage cable which, as explained above, is highly undesirable. Specifically, electrical arcing places an undue amount of electrical stress on the cathode insulating structure and the high-voltage cable, which may affect the performance of the x-ray tube and reduce the operating life of the various components therein.

The inability of known high voltage cable clamp systems to determine the amount of applied force between the high voltage cable and cathode insulating structure is exacerbated by other factors. One of those factors is that the high-voltage cable expands and contracts in response to temperature variations present within the tube during operation. When the tube heats up during operation, the high voltage cable heats up as well, which causes it to expand in size. This expansion normally maintains the close fit between the high voltage cable and the inner surface of the cathode insulating structure. When the tube temperature drops, however, such as in response to cooling provided by the tube cooling system, the high voltage cable contracts in size, which may cause the outer surface of the cable to retract slightly from the inner surface of the cathode insulating structure. Gaps created by this retraction increase the chances of electrical arcing, which, as explored above, is undesirable. The high-voltage cable is more likely to have a gap introduced between it and the cathode insulating structure when the proper amount of compressive force has not been applied by the cable clamp. Thus, application of the proper amount of compressive force upon the portion of the high-voltage cable disposed within the cathode insulating structure is critical to ensure the proper operation of the x-ray tube, and more particularly, to avoid the above-described problems associated with electrical arcing.

Further, prior clamp designs have not allowed for the possibility of a low profile connection between the x-ray tube and the high-voltage cable. Such a low profile connection may be desirable where space immediately surrounding the x-ray tube housing is limited.

A need therefore exists for a system for securing a high-voltage electrical cable to an electrical device, such as an x-ray tube, in a low profile configuration. A further need exists for a clamp system that allows the user to easily determine and/or to modify the amount of compressive force being applied to the high-voltage cable within a cathode insulating structure of an x-ray tube such that the operation of the cathode and the entire tube is optimized. It would also be an advantage for the clamp system to enable easy adjustment of the compressive force on the high-voltage cable as may be needed or desired by the user.

BRIEF SUMMARY OF THE INVENTION

In accordance with the invention as embodied and broadly described herein, the foregoing needs are met by a high voltage cable and clamp system for securely maintaining the high voltage cable within an electrical device, such as an x-ray tube. Embodiments of the present invention are directed to a specialized high voltage cable assembly sized and configured to be received within a conical cathode insulator. A clamp assembly imposes a continuously compressive force on the cable assembly sufficient to maintain a tight fit between the cathode insulator and the high voltage cable assembly, thereby avoiding electrical arcing therebetween during tube operation. The compressive force imposed by the clamp assembly is easily determined and adjusted by the user as needed. The high voltage cable and clamp system has a low profile to minimize the amount of space needed to house the system.

In a first embodiment, the high voltage cable assembly comprises a high voltage cable connected at one end to a high voltage power source and at the other end to a plug connector. The plug connector is adjustably connected to the housing or vacuum enclosure of an x-ray tube and serves to electrically connect the high voltage cable to the cathode. The plug connector preferably comprises first and second sections disposed at a right angle to one another. A shallow, cylindrical cavity is defined on the first section near the vertex of the right angle such that the longitudinal axis of the second section of the plug connector is coaxial with the central axis of the cavity. The outer surface of the second section of the plug connector converges to define a frusto-conical shape for complementarily fitting against the inner surface of the x-ray tube cathode insulator, which is also frustoconically shaped. The tip of the second section of the plug connector has electrical contacts for electrically connecting to cathode terminals disposed in the convergent end of the cathode insulator.

A substantial portion of the plug connector is disposed within the clamp assembly of the present invention, which is adjustably attached to the x-ray tube via screws or the like. When attached to the x-ray tube, the clamp assembly defines a conduit in which a substantial portion of the first section of the plug connector is disposed. The clamp assembly also defines a cylindrical volume in communication with the plug connector conduit, and has a central axis that is coaxial with the longitudinal axis of the second section of the plug connector. Disposed at least partially within the cylindrical volume of the clamp assembly is a plunger/spring assembly comprising a solid, cylindrical plunger and a spring. A retention screw extending through the spring is attached at one end to the plunger and slidably attached at the other end to a portion of the clamp body. The retention screw maintains the relative position of each of the plunger/spring assembly components during assembly or disassembly of the high voltage cable and clamp system.

In one embodiment, the plunger extends between the end of the spring disposed at least partially in the cylindrical volume of the clamp body and the cavity defined in the first section of the plug connector. A portion of the plunger fits inside the cavity.

The successful operation of an x-ray tube depends in part upon the integrity of the fit between the high voltage cable plug connector and the cathode insulator. As described above, damaging electrical arcing between the plug connector and the cathode insulator may occur if any gap develops therebetween. Complicating this situation is the fact that the plug connector expands and contracts during tube operation in response both to the heat created when x-rays are produced within the tube and to the cooling operations designed to remove that heat. The expansion and contraction of the plug connector increases the chance of gaps between it and the cathode insulator to develop, which increases the possibility for arcing to occur.

The present high voltage cable and clamp assembly prevents such electrical arcing by establishing and maintaining a close fit between the cathode insulator and the high voltage cable plug connector. When properly attached to an x-ray tube, and when the plug connector is relatively cool, such as immediately following the startup of the x-ray tube, the high voltage cable and clamp assembly imparts a sufficient amount of compressive force to the second section of the plug connector so as to maintain it in proximate contact with the inner surface of the cathode insulator. As tube operation continues and the interior tube temperature increases, the temperature of the plug connector rises as well, thus causing the connector to thermally expand. The thermal expansion of the plug connector causes a longitudinal lengthening of the second section of the plug connector, which in turn causes a consequent translation of the plunger, which is partially disposed in the plug connector cavity, up into the cylindrical volume of the clamp assembly. The spring of the plunger/spring assembly reacts to the plunger movement by contracting, thereby maintaining sufficient compressive force upon the second section of the plug connector while allowing the connector to expand. When the plug connector again cools and thermally contracts in size, the spring expands, thereby urging the second section of the plug connector against the inner surface of cathode insulator via the plunger and cavity, thus maintaining a tight fit between the two components.

The compressive force provided by the spring in the plunger/spring assembly may be readily determined via a calibration window defined in a portion of the clamp assembly body. An operator may look through the window to determine the relative position of the plunger, and may adjust the position of the clamp body relative the outer portion of the x-ray tube to which it is attached by adjusting the several screws that affix the clamp body to the tube. The calibration window may be configured with a scale to quantitatively indicate the compressive force being imposed upon the plug connector by the plunger/spring assembly. In this way, an operator may accurately determine the compressive force of the cable and clamp system at any point during the operation of the tube simply by inspecting the position of the plunger through the calibration window.

In a second embodiment, the spring of the plunger/spring assembly comprises a plurality of Belleville-type spring washers disposed in a stacked configuration within the cylindrical volume of the clamp body.

In a third embodiment, an even more compact high voltage cable and clamp system is disclosed wherein the springs of the plunger/spring assembly comprise a plurality of spring washers that are at least partially disposed in the cavity of the first section of the high voltage cable plug connector. The plunger has a shape distinct from that of the other embodiments. Also, the relative positions of the plunger and spring are reversed in this embodiment such that a portion of the spring is disposed in the cavity of the plug connector while the plunger is disposed at least partially within the cylindrical volume of the clamp body. The clamp body has a lower profile, making the cable and clamp system of this embodiment especially useful where little free space is available around the x-ray tube.

The foregoing features of the present high voltage cable and clamp system enable, among other things, a high voltage cable to be secured within an x-ray tube utilizing reliable and inexpensive components. The design of the cable and clamp system is simple and has a low profile, thereby allowing the x-ray tube to be disposed in a relatively smaller space. Also, use of the calibration window enables an operator to readily and accurately determine the amount of compressive force present in the system at an time. Other high voltage electrical devices in addition to x-ray tubes may benefit from the features of the present invention as may be appreciated by those skilled in the art.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made to figures wherein like structures will be provided with like reference designations.

It is understood that the drawings are diagrammatic and schematic representations of presently preferred embodiments of the invention, and are not limiting of the present invention nor are they necessarily drawn to scale. FIGS. 1–13 depict several embodiments of the present invention, which is generally directed to an apparatus and method for maintaining a high voltage cable in a low profile, secured position within an electrical device, such as an x-ray tube. It is noted here that terms such as top, bottom, upper, and lower are merely descriptive words to be used herein to enable a sufficient description of the high voltage cable and clamp system to be made. Accordingly, such terms are not meant to limit the scope of the present invention in any way.

Figure 1:
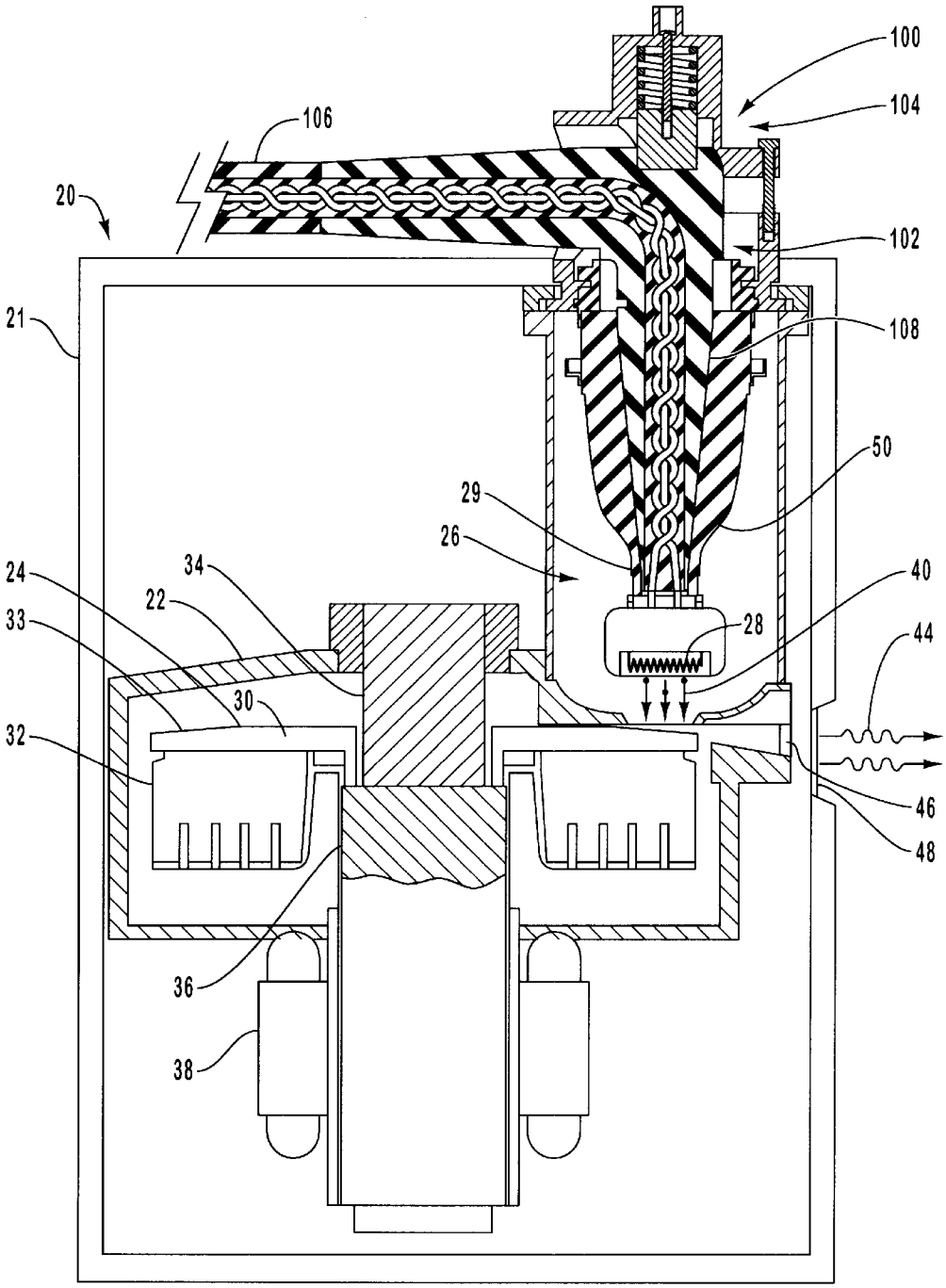
FIG. 1 is a cross sectional side view of an x-ray tube incorporating features of a first embodiment of the present invention.

Reference is first made to FIG. 1, which depicts a single-ended x-ray tube 20 incorporating various features of the present high voltage cable and clamp system. The x-ray tube 20 preferably includes an outer housing 21 and a vacuum enclosure 22 disposed within the housing 21. A rotary anode 24, and a cathode 26 are disposed inside the vacuum enclosure 22. The anode 24 is spaced apart from and oppositely disposed to the cathode 26 to receive electrons emitted by a filament 28 disposed in the cathode. A target surface 30 typically comprising a heavy metallic material is disposed on a graphite substrate 32 of the anode 24. The anode 24 is rotatably supported by a support stem 34 and a bearing assembly 36, which allows the anode to be rotated during tube operation by a motor, such as a stator 38.

The present high voltage cable and clamp system 100 is also shown in FIG. 1 and generally includes a high voltage cable assembly 102 and a clamp assembly 104. In addition to supplying electrical power to the cathode 26, the high voltage cable and clamp system 100 properly secures the high voltage cable assembly 102 within the x-ray tube 20 while maintaining the portion of the cable assembly that extends from the x-ray tube in a low profile configuration. These and other features of the present invention are discussed further below. One skilled in the art will appreciate that, though the embodiments of the present invention described herein are discussed in connection with an x-ray tube, other electrical devices may also benefit from incorporation of features of the present invention.

In order for the x-ray tube 20 to produce x-rays, the cathode 26 is electrically biased by the high voltage cable assembly 102 such that a high voltage potential is established between the cathode and the anode 24. In this arrangement, the cathode 26 is biased with a high negative voltage while the anode 24 is maintained at or near ground potential. X-ray tubes of this type are commonly referred to as single-ended tubes. An electric current is then passed through the filament 28, causing a cloud of electrons, designated at 40, to be emitted from the filament by thermionic emission.

An electric field created by the high voltage potential existing between the anode 24 and the cathode 26 causes the electron stream 40 to accelerate from the cathode toward the target surface 30 of the rotating anode. As they accelerate toward the target surface 30, the electrons 40 gain a substantial amount of kinetic energy. Upon approaching and impacting the anode target surface 30, many of the electrons 40 are rapidly decelerated, thereby converting their kinetic energy into electromagnetic waves of very high frequency, i.e., x-rays. rays. The resulting x-rays, designated at 44, emanate from the anode target surface 30 and are collimated through windows 46 and 48 disposed in the vacuum enclosure 22 and outer housing 21, respectively. The collimated x-rays 44 are then directed for penetration into an object, such as an area of a patient's body. As is well known, the x-rays 44 that pass through the object can be detected, analyzed, and used in any one of a number of applications, such as x-ray medical diagnostic examination or materials analysis procedures.

Figure 2:
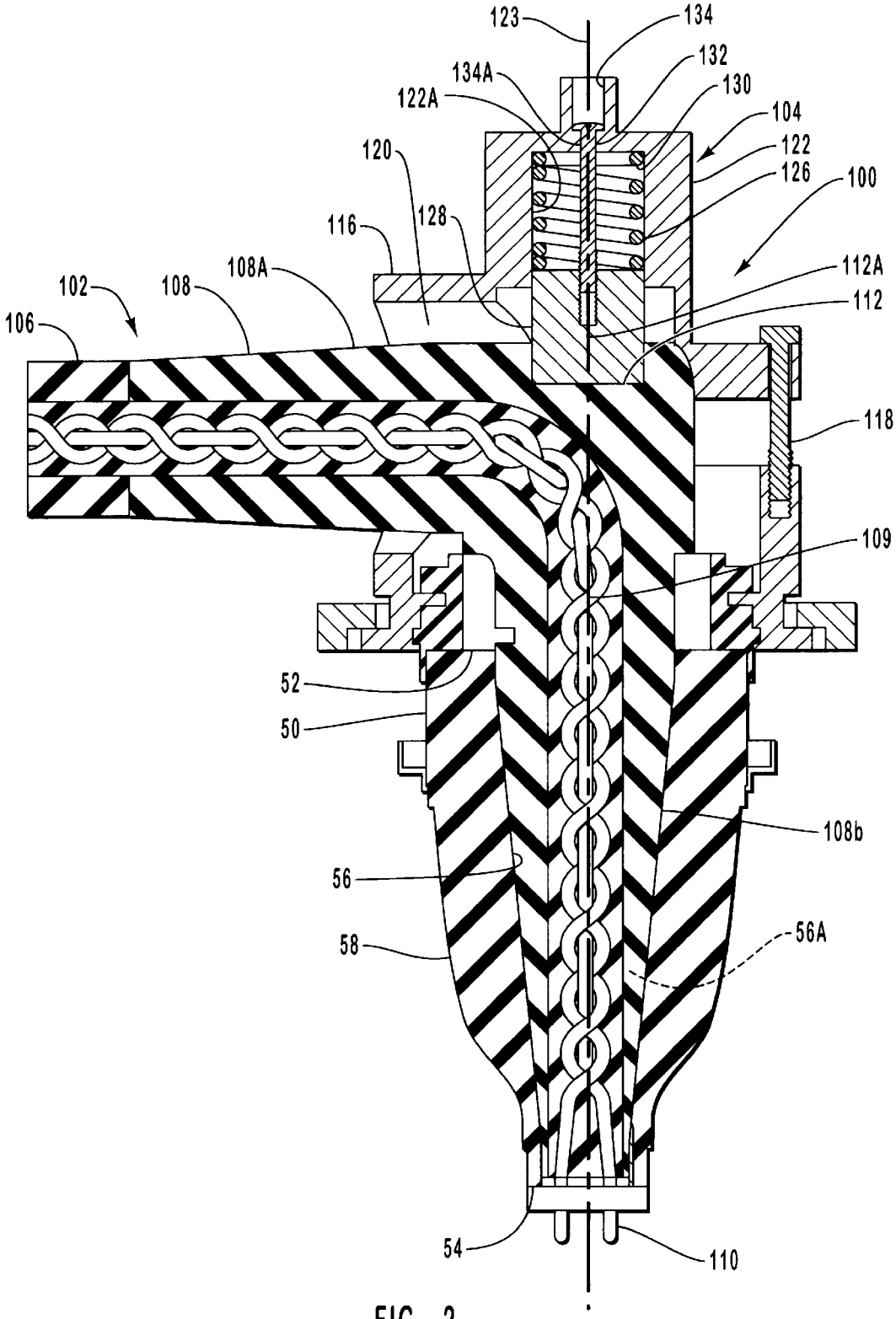
FIG. 2 is a cross sectional side view of the present high voltage cable and clamp system in accordance with a first embodiment thereof.

Reference is now made to FIG. 2, which depicts a portion of the x-ray tube 20 near the cathode 26. The cathode 26 of the single-ended x-ray tube 20 is structurally supported by a cathode insulator 50. The cathode insulator 50 typically comprises a frustoconical shape having first and second open ends 52 and 54, respectively. It is affixed at the first end 52 to either the outer housing 21 or the vacuum enclosure 22, and affixed at the second end 54 to the cathode 26, thereby supporting the cathode in a position where the electrons 40 may be efficiently emitted by the filament 28 toward the anode 24. The cathode cone 40 also comprises an inner surface 56 defining a frustoconical volume, and an outer vacuum surface 58, which is exposed to the vacuum maintained by the vacuum enclosure 22. In order to electrically isolate the high voltage cathode 26 from other portions of the x-ray tube 20, the cathode insulator 50 is typically composed of an electrically insulating material, such as glass or ceramic.

FIG. 2 depicts various features of a first embodiment of the present high voltage cable and clamp system 100. The high voltage cable and clamp system 100 generally comprises a high voltage cable assembly 102 and a clamp assembly 104. The high voltage cable assembly 102 comprises a high voltage cable 106 containing electrically conductive wires wrapped in one or more protective and insulative coverings. One end of the cable 106 is connected to an electric power source (not shown), while the other end is disposed within a plug connector 108, which comprises a first section 108A and a second section 108B.

Figure 3:
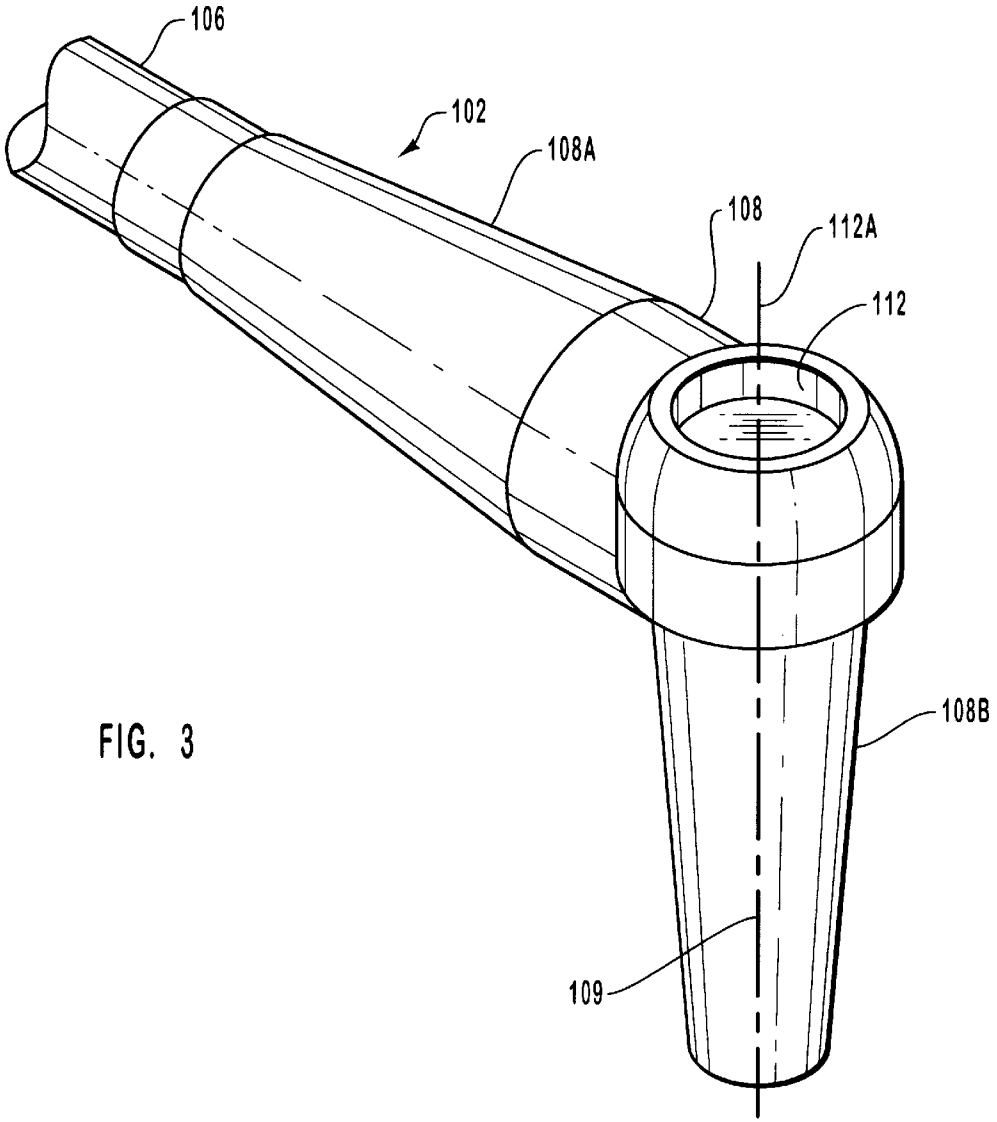
FIG. 3 is a perspective view of the high voltage cable plug connector shown in FIG. 2.

The plug connector sections 108A and 108B are preferably disposed at a right angle with respect to one another, as shown in FIG. 3. The second section 108B occupies the volume 56A created by the inner surface 56 of the cathode insulator 50 and is frustoconically shaped to physically engage a substantial portion of the inner surface of the cathode insulator. The free end of the second section 108B of the plug connector 108 preferably has disposed therein female connectors for electrically connecting with a plurality of cathode terminals 110 extending into the volume 56A. The frustoconical outer covering of the second section 108B of the plug connector 108 preferably comprises a non-conductive material, such as rubber or thermoplastic, to help insulate the high voltage cable 106 contained therein. One of skill will appreciate that the plug connector may comprise only a portion of the first and second sections 108A, 108B. Accordingly, the high voltage cable 106 may comprise a portion of the first and second sections 108A, 108B. Also, it is appreciated that the plug connector 108 may comprise others shapes in order to cooperatively fit within a cathode insulator having a shape distinct from that described above.

As best seen in FIG. 3, the first section 108A of the plug connector 108 is generally cylindrical, and has defined therein a shallow, cylindrical cavity 112 near the vertex of the right angle defined by the first section and the second section 108B. The cavity 112 is situated in the first section 108A such that a central axis 112A of the cavity is coaxial with the longitudinal axis 109 of the second section 108B of the plug connector 108. Though preferably circular, the cavity 112 may comprise other cross sectional shapes, such as a square or a hexagon.

Figure 4A:
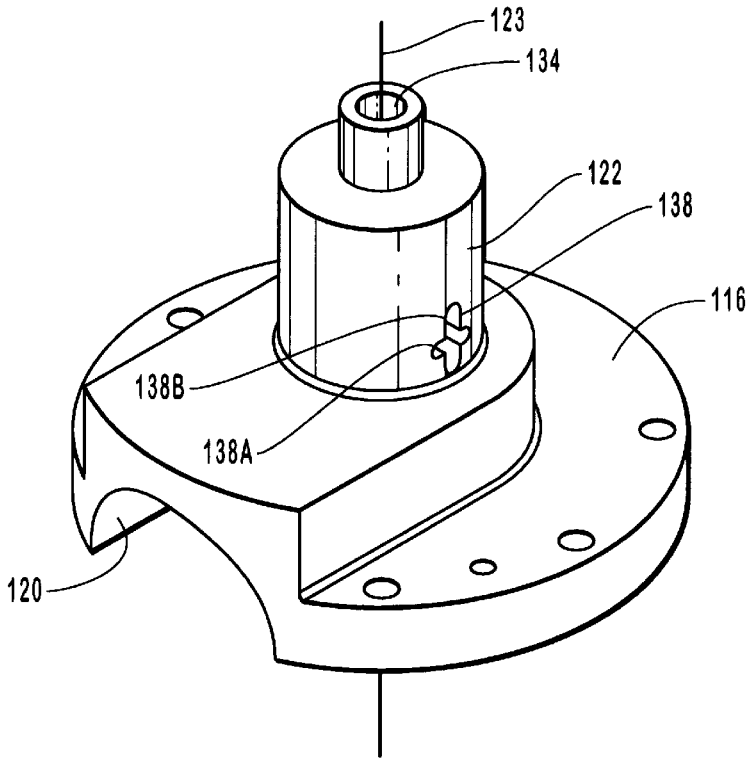
FIG. 4A is a perspective view of the clamp body of the present high voltage cable and clamp system shown in FIG. 2.
Figure 4B:
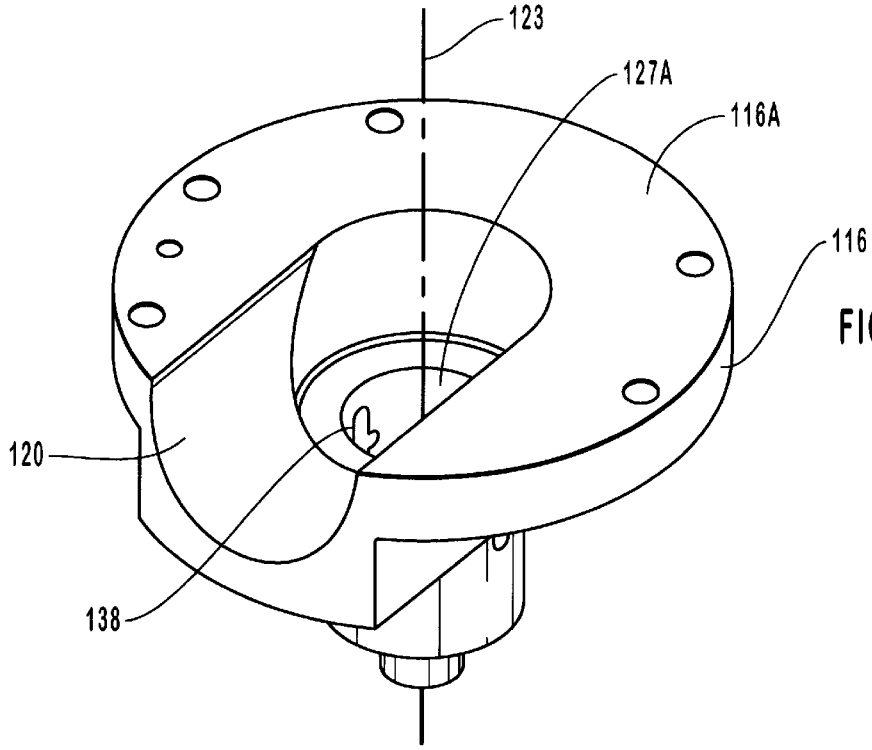
FIG. 4B is another perspective view of the clamp body shown in FIG. 3A.

Reference is now made to FIGS. 2, 4A, and 4B in discussing selected features of the clamp assembly 104 of the high voltage cable and clamp system 100. The clamp assembly 104 generally comprises a clamp body 116 made from a durable and heat resistant material, such as stainless steel. The clamp body 116 is attached preferably to the vacuum enclosure 22 of the x-ray tube 20 via a plurality of adjustment screws 118 or similar fasteners, though one skilled in the art will appreciate that the clamp body could also be affixed to a portion of the outer housing 21. As will be explained further below, the adjustment screws 118, in addition to affixing the clamp body 116 to the x-ray tube 20, also allow for the proximity of the clamp body to the surface of the vacuum enclosure 22 to be varied.

The clamp body 116, attached to the vacuum enclosure 22, defines a conduit 120 on a bottom surface of the clamp body, in which is at least partially disposed the first section 108A of the plug connector 108. The vertex of the right angle defined by the first and second sections 108A, 108B is also substantially disposed in the conduit 120. The clamp body 116 further comprises a hollow cylindrical portion 122 defining a cylindrical volume 122A having a central axis 123 that, like the cavity 112, is coaxial with the longitudinal axis of the second section 108B of the plug connector 108. The cylindrical volume 122A joins with the conduit 120 and houses a plunger/spring assembly 126 for applying a compressive force upon the high voltage cable assembly 102.

Figure 5:
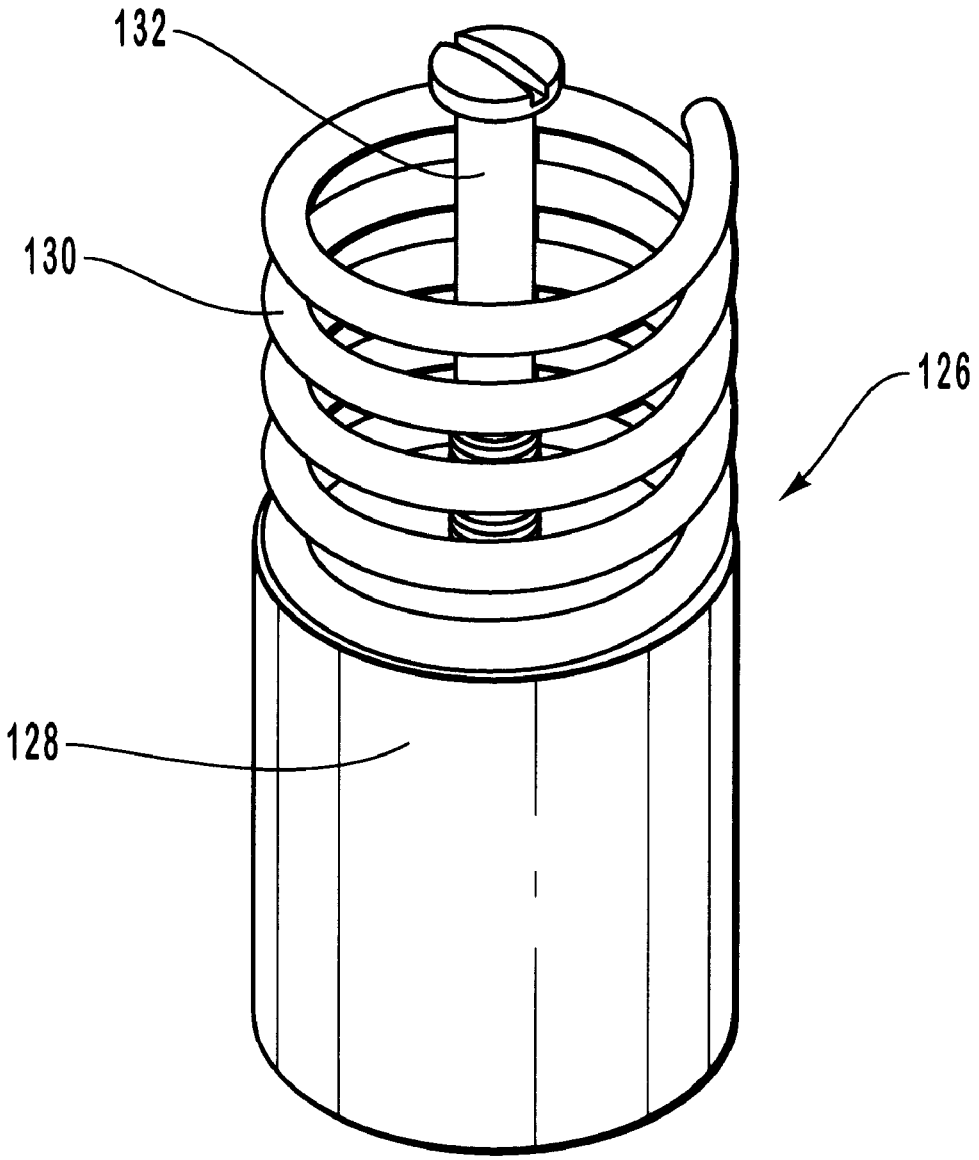
FIG. 5 is a perspective view of the plunger/spring assembly of the present high voltage cable and clamp system shown in FIG. 2.

A perspective view of the plunger/spring assembly 126 is shown in FIG. 5. It comprises a plunger 128, a retention screw 132, and a means for providing a compressive force to the plunger, which in this embodiment, comprises a coiled spring 130. The retention screw 132 connects the plunger 128 and the spring 130 to the clamp body 116. To this end, the head of the retention screw 132 is slidably retained by a retention screw cavity 134 defined in the top of the cylindrical portion 122. An aperture 134A defined in the bottom of the retention screw cavity 134 enables the body of the retention screw 132 to pass through and engage the spring 130 and the plunger 128. The retention screw 132 is useful for retaining the plunger 128 and the spring 130 with to the clamp body 116 during assembly/disassembly of the high voltage cable and clamp system 100; it does not limit relative movement between the plunger 128 and the spring 130.

At least a portion of the plunger 128 is sized to cooperatively fit within the cavity 112 defined in the first section 108A of the plug connector 108. The cross sectional shape of the plunger 128 is preferably circular, in accordance with the preferred shape of the cavity 112, though it may comprise other shapes as well. The plunger 128 is responsible for imparting a compressive force to the cable assembly 102 during tube operation. Thus, one end of the plunger 128 is disposed within the cavity 112 of the plug connector first section 108A while the other end is disposed adjacent the spring 130.

The spring 130, as a means for providing a compressive force to the plunger 128, is disposed within the volume 122A defined by the cylindrical portion 122 of the clamp body 116. It extends between the plunger 128 and the end of the volume 122A nearest the retention screw cavity 134. The spring 130 provides a compressive force to the plunger 128 for securing the high voltage cable assembly 102 during tube operation, as explained below.

Figure 6:
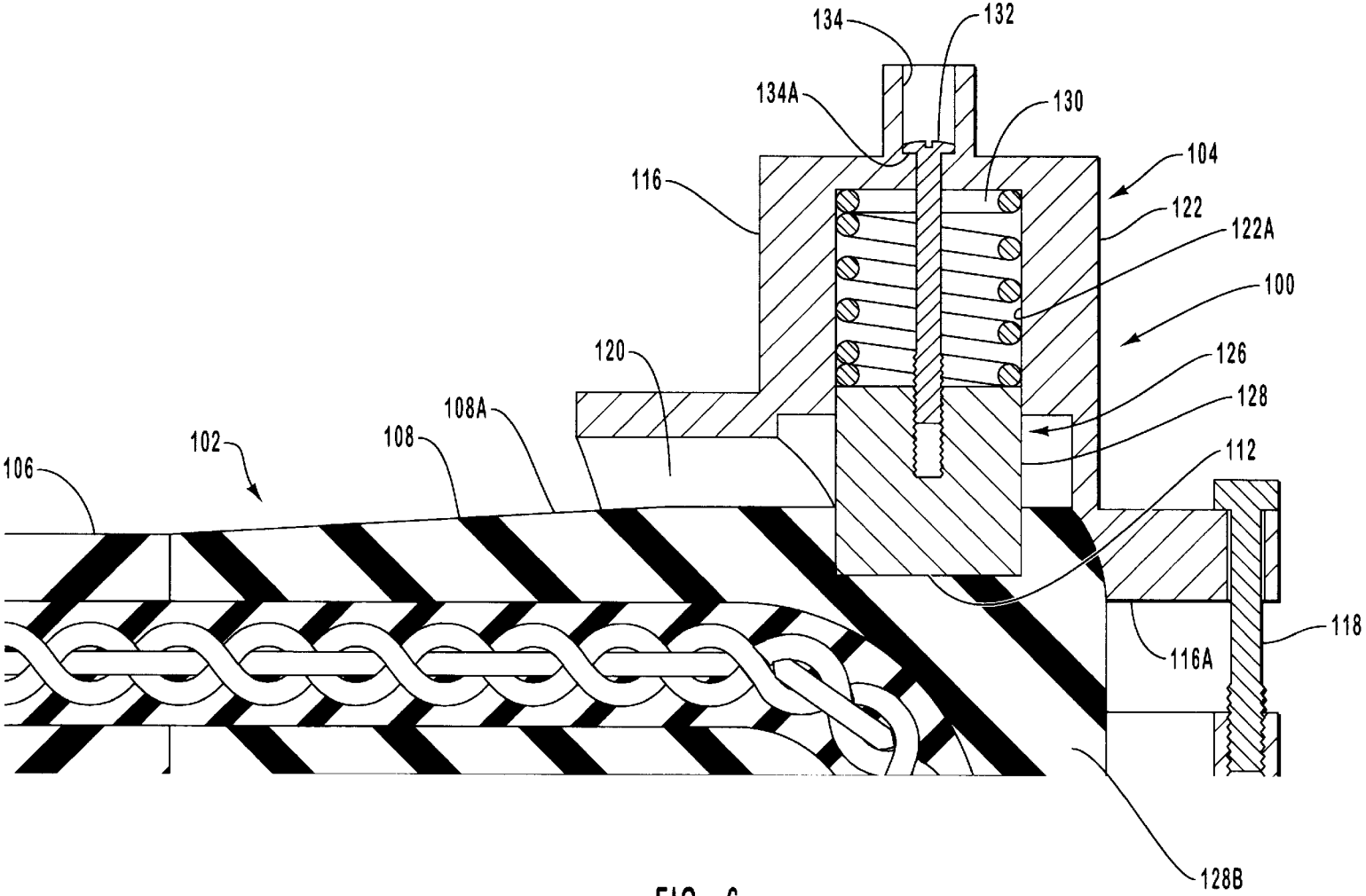
FIG. 6 is a cross sectional side view of the high voltage cable and clamp system shown in FIG. 2, depicting various details thereof.

In FIG. 6, several of the various components comprising the high voltage cable and clamp system 100 are shown ready to operate. In accordance with the desired results achieved by the present invention, the high voltage cable and clamp system 100 secures the high voltage cable 106 within the x-ray tube 20 while ensuring that a close fit is maintained between the second section 108B of the plug connector 108 and the inner surface 56 of the cathode insulator 50.

During tube operation, the high-voltage cable assembly 102 is secured within the x-ray tube 20 by way of the clamp assembly 104. In the secured position, the second section 108B of the plug connector 108 is disposed within the volume 56A of the cathode insulator 50 such that the outer covering of the second section is in physical contact with the inner surface 56. This contact is achieved and maintained as a result of the downward compressive force imparted to the second section 108B by the clamp assembly 104, namely, the plunger/spring assembly 126. The downward compressive force provided by the spring 130 of the plunger/spring assembly 126 is received by the plug connector 108 by virtue of the placement of the plunger 128 within the cavity 112 defined in the plug connector first section 108A. Because the cavity 112 is disposed directly above the longitudinal axis 109 of the second section 108B, the force from the plunger 128 received by the cavity is transferred directly to the second section, which force maintains the outer surface of the second section in continuous physical contact with the inner surface 56 of the cathode insulator 50. In this way, gaps between the plug connector second section 108B and the cathode insulator inner surface 56 are avoided, thereby reducing the likelihood of electrical arcing.

The present high voltage cable and clamp system 100 also compensates for the expansion and contraction of the high voltage cable assembly 102 during the operation. When the x-ray tube 20 is first turned on the tube components, including the high voltage cable assembly 102, are relatively cool. In this state, the high voltage cable 106 and plug connector 108 possess a certain size in accordance with their cooled state. The second section 108B of the plug connector 108 is maintained in physical contact with the inner surface 56 of the cathode insulator 50 as explained above.

As a natural consequence of x-ray tube operation, heat is produced within the outer tube housing 21. This causes significant heating of the high voltage cable 106 and the plug connector 108. When heated, the plug connector 108 expands in size, which causes it to occupy more volume within the conduit 120 and the cathode insulator 50. The expansion of the high voltage cable assembly 102 also causes the cavity 112 to move slightly upward toward the plunger 128. The plunger/spring assembly 126 of the high voltage cable and clamp system 100 compensates for this expansion by contracting in response to the upward movement of the plug connector 108 and cavity 112. In this way, the high voltage cable assembly 102 is allowed to safely expand, while still receiving an adequate compressive force by the plunger/spring assembly 126 to keep the second section 108B of the assembly in contact with the cathode insulator 50.

Cooling operations present in the x-ray tube during operation thereof may remove sufficient quantities of heat from the high voltage cable assembly 102 so as to allow it to contract. In response to the contraction of the high voltage cable assembly 102, the plunger/spring assembly 126 expands to maintain sufficient compressive force upon the second section 108B via the cavity 112 in order to keep the second section in continual physical contact with the cathode insulator 50. Thus, it is seen that the high voltage cable and clamp system 100 is able to maintain an adequate force upon the high voltage cable assembly 102 so as to maintain a continuous physical contact between it and the cathode insulator 50 at all times, thereby avoiding electrical arcing and other problems associated with the failure to maintain such contact.

Figure 7:
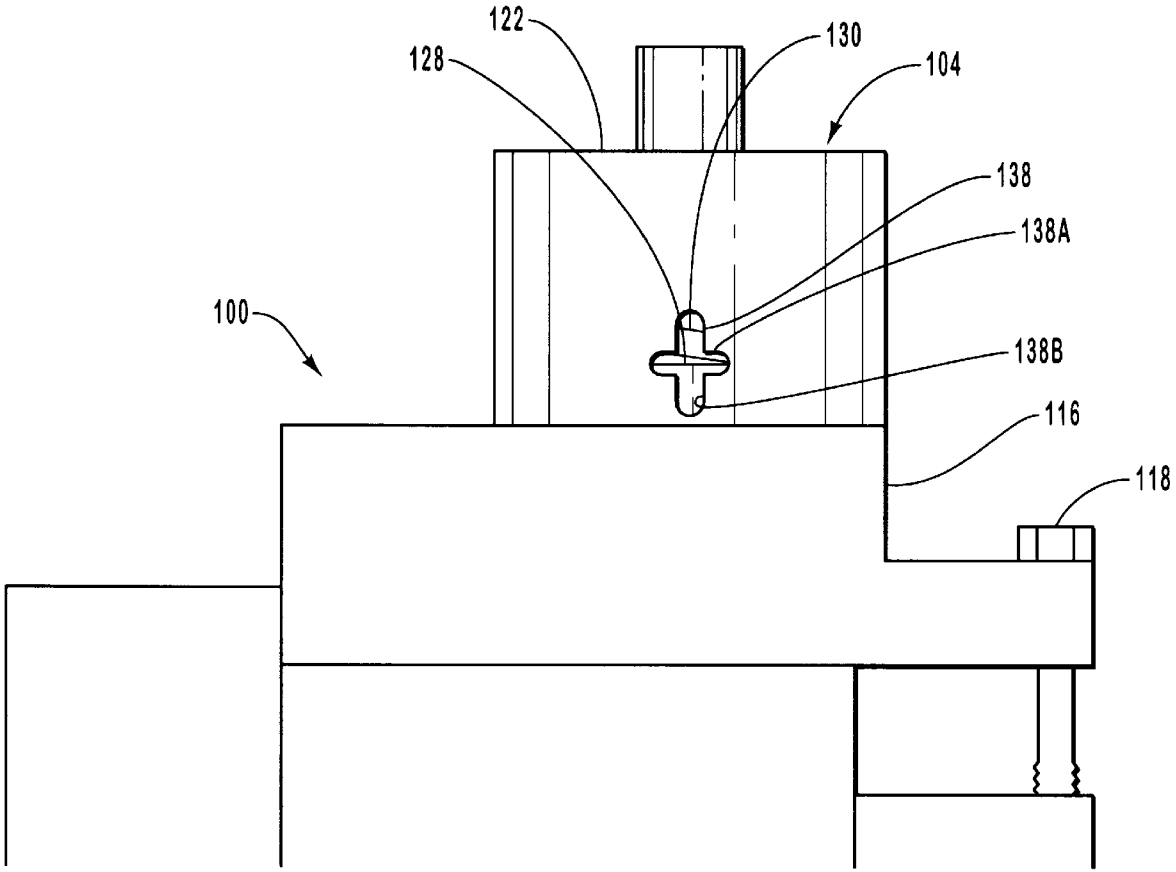
FIG. 7 is a side view of the clamp body shown in FIG. 2, depicting the calibration window defined in a side thereof.

Reference is now made to FIG. 7, which shows a calibration window 138. As partially explained above, a proper level of compressive force must be imparted to the high-voltage cable assembly 102 by the plunger/spring assembly 126 in order to achieve a close fit between the second section 108B and the inner surface 56 of the cathode insulator 50. The level of compressive force imparted by the plunger/spring assembly 126 may be determined during initial assembly and calibration of the x-ray tube, or at any time during the operating lifetime of the x-ray tube, by using the calibration window 138. The calibration window 138 is defined in the side of the cylindrical portion 122 of the clamp body 116 and extends from the outer surface of the cylindrical portion 122 to the cylindrical volume 122A to allow a technician to view the relative position of the top of the plunger 128 within the volume. The window 138 may have disposed therein a transparent material such as glass in order to prevent contamination of the cylindrical volume 122A, while permitting visual access thereto.

The calibration window 138 may be configured to indicate predetermined quantities of compressive force. For example, the window 138 shown in FIG. 7 features a horizontal portion 138A extending across the vertically oblong main window section 138B. If the position of the top of the plunger 128 as seen through the window 138 corresponds to the bottom surface, or bottom marker, of the horizontal portion 138A, the technician may determine that the level of compressive force indicated by the bottom marker is the quantity of compressive force currently being applied by the plunger to the high voltage cable assembly 102 via the cavity 112. Likewise, the top of the plunger 128 may be seen through the window to be located near the top surface, or top marker of the horizontal portion 138A, which would indicate that the quantity of compressive force corresponding to that marker is currently present on the high voltage cable assembly 102.

The horizontal portion 138 is one non-limiting example of how quantitative measurements of compressive force imparted by the plunger/spring assembly 126 may be made; accordingly, other manners by which the compressive force may be determined, including calibration window features having different sizes and shapes, are contemplated to fall under the claims of the present invention.

If, after viewing the plunger position the technician determines that the level of compressive force being imparted to the high voltage cable assembly 102 is not satisfactory, adjustments may readily be made to the high voltage cable and clamp system 100 to alter the applied force. To do so, the adjustment screws 118 are rotated, thereby bringing the clamps body 116 either closer or farther away from the portion of the vacuum enclosure 22 or outer housing 21 to which the clamp body is mounted. In so doing, the amount of compressive force offered by the plunger/spring assembly 126 to the high voltage cable assembly 102 will be proportionally altered. For example, if the technician has determined that a greater amount of compressive force should be imparted by the plunger/spring assembly 126, the adjustment screws 118 are each rotated to reduce the distance between the clamp body 116 and the portion of the vacuum enclosure 22 to which the clamp body is connected. It is noted that sufficient clearance exists between the inner surface of the conduit 120 and the high voltage cable assembly 102 disposed therein to enable the clamp to be adjusted as explained herein without unduly constricting the cable assembly. The reduction in clamp body-to-vacuum enclosure distance correspondingly reduces the longitudinal length of the cylindrical volume 122A in which the plunger/spring assembly 126 is at least partially disposed. The spring 130, in turn, is compressed to a greater degree within the volume 122A, in reaction to which a relatively greater compressive force is created by the spring and transferred through the plunger 128 and the cavity 112 to the second section 108B of the high voltage cable assembly 102, as desired. Alternatively, the technician could rotate the adjustment screws 118 such that the distance between the vacuum enclosure 22 or outer housing 21 to the clamp body 116 is lengthened, which would correspondingly reduce the relative amount of compressive force imparted by the plunger/spring assembly 126. After adjusting the adjustment screws 118, the technician may immediately ascertain the amount of compressive force by again inspecting the calibration window 138 in order to determine whether further adjustments are needed. In this way, the proper amount of compressive force imparted by the plunger/spring assembly 126 may be continuously identified and adjusted.

FIGS. 8–12B depict other embodiments of the present high voltage cable and clamp system 100. To the extent that features of the second and third embodiments below are similar to those of the first embodiment, they will not be thoroughly discussed. Accordingly, only selected features of the following embodiments will be discussed herein.

Figure 8:
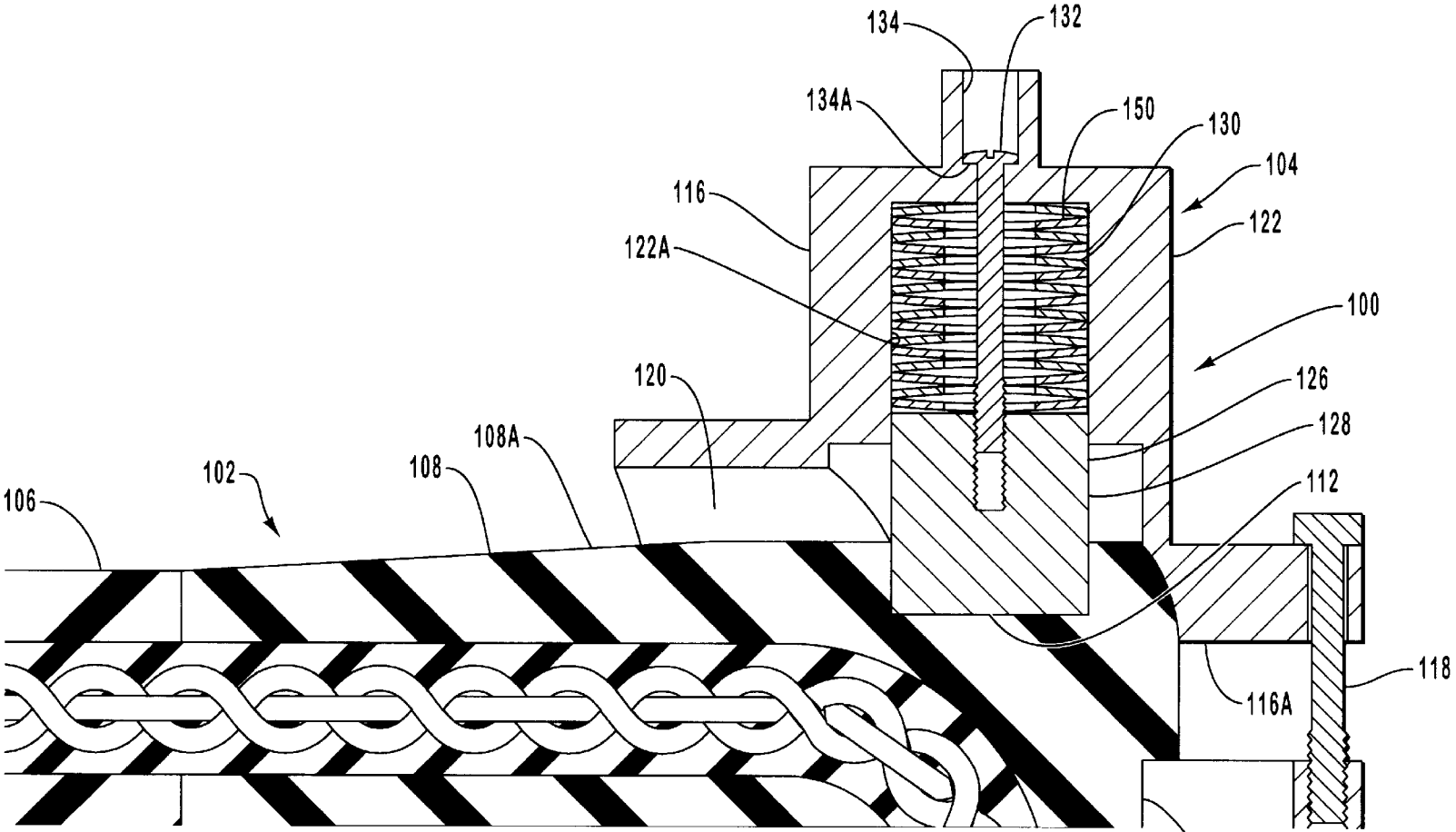
FIG. 8 is a cross sectional side view depicting various features of the present high voltage cable and clamp system in accordance with a second embodiment thereof.

Reference is now made to FIG. 8, which depicts a second embodiment of the present high voltage cable and clamp system 100. In this second embodiment, another means for providing a compressive force to the plunger is disclosed, wherein the spring 130 of the plunger/spring assembly 126 comprises a plurality of Belleville-type spring washers 150 arranged "back-to-back" in a stacked configuration about the retention screw 132. In such an arrangement, the plurality of spring washers 150 provides the necessary compressive force to the plunger 128 for maintaining the second section 108B of the high voltage cable assembly 102 in close and continual physical contact with the inner surface 56 of the cathode insulator 50.

Figure 9B:
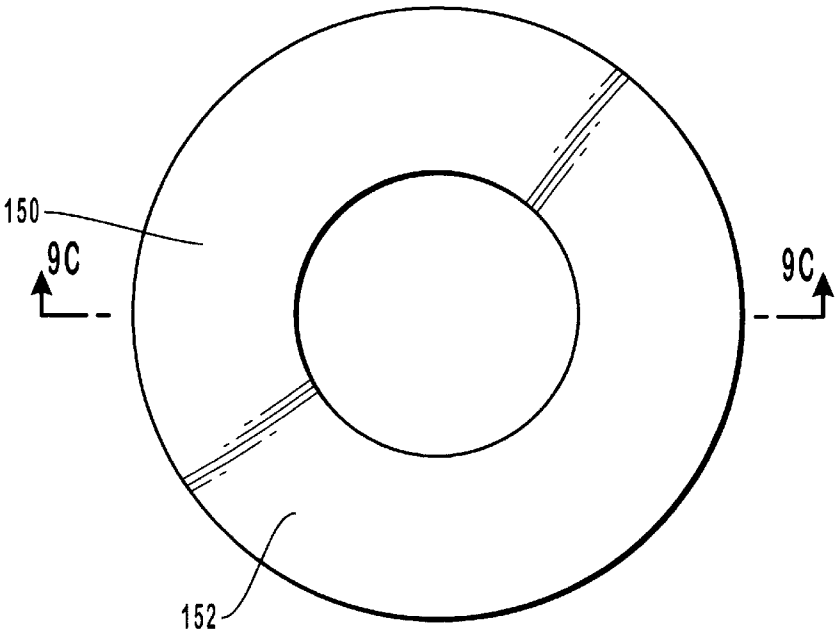
FIG. 9B is a top view of the Belleville spring washer of FIG. 9A.
Figure 9C:
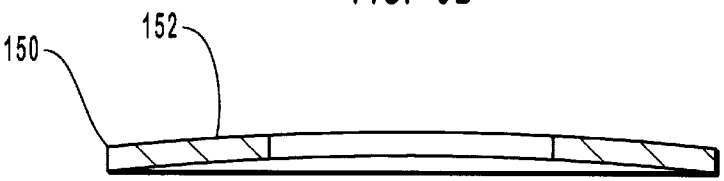
FIG. 9C is a cross sectional side view of the Belleville spring washer of FIG. 9B, taken along the line 9C—9C.
Figure 9A:
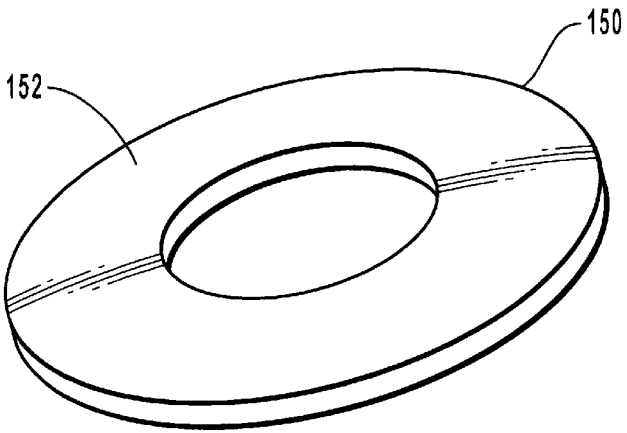
FIG. 9A is a perspective view of a Belleville spring washer employed in several of the embodiments of the present high voltage cable and clamp system.

Various views of a Belleville spring washer 150 are given in FIGS. 9A–9C. As seen in the figures, the spring washer 150 comprises an annular metal disk having an angled body 152 to allow it to compress under an applied force. A plurality of spring washers 150 disposed within the cylindrical volume 122A as seen in FIG. 8 allows the plunger/spring assembly 126 to expand and contract in response to the thermal expansion and contraction of the high voltage cable assembly 102 during tube operation. The number of spring washers 150 that are disposed within the cylindrical volume 122A depends on various factors, including the longitudinal length of the cylindrical volume, and the desired range of displacement of the plunger/spring assembly 126 in response to the thermal expansion and contraction of the high voltage cable assembly 102. An advantage of using a stack of Belleville spring washers as the spring 130 is derived from their combined ability to increase the range of displacement of the plunger/spring assembly 126 without increasing the spring constant of the stack. Preferably, sixteen (16) spring washers 150 are disposed back-to-back within the cylindrical volume 122A, though any number of spring washers is possible. In addition to Belleville spring washers, other means for providing a compressive force to the plunger could comprise the spring 130 for securing the high voltage cable assembly 102 in this and the other embodiments. Accordingly, the various embodiments of the spring 130 described herein are not meant to limit the present invention in any way.

Figure 10:
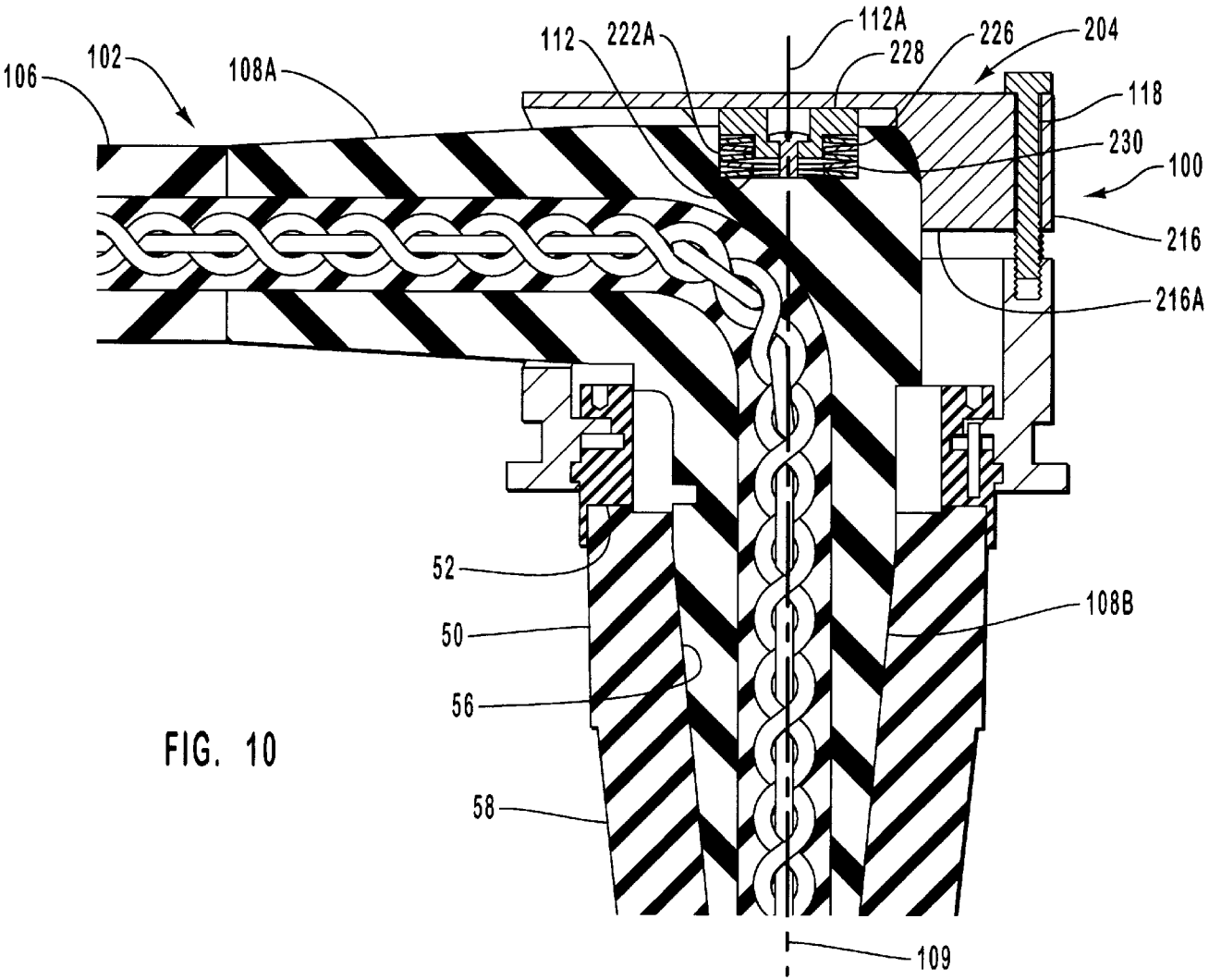
FIG. 10 is a cross sectional side view depicting various features of the present high voltage cable and clamp system in accordance with a third embodiment thereof.

Reference is now made to FIG. 10, which depicts a third embodiment of the high voltage cable and clamp system 100. Some x-ray tubes may require a lower profile high voltage cable attachment system than what is achieved with the previous embodiments of the high voltage cable and clamp system 100. The cable and clamp system 100 of the third embodiment generally comprises a high voltage cable assembly 102 and a clamp assembly 204 having a thin clamp body 216. Housed within the clamp body 216 is a reduced-length plunger/spring assembly 226 for maintaining a continual, compressive force on the high voltage cable assembly 102 disposed within the cathode insulator 50.

Figure 11B:
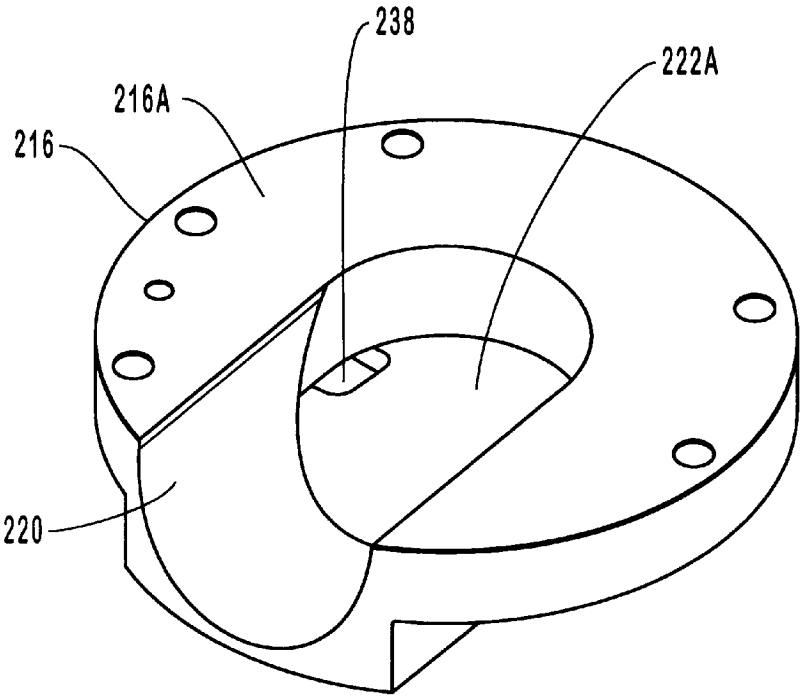
FIG. 11B is another perspective view of the clamp body of FIG. 10.
Figure 11A:
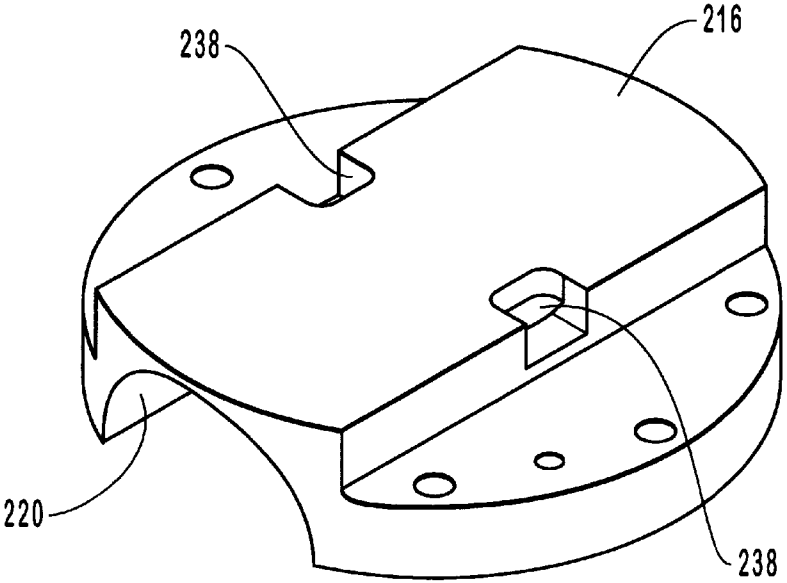
FIG. 11A is a perspective view of the clamp body of FIG. 10.

As best seen in FIGS. 11A and 11B, the clamp body 216 comprises a substantially circular disk composed of stainless steel or other suitable material. A semi-cylindrical conduit 220 is defined on a bottom surface 216A of the clamp body 216. When the clamp body 216 is attached to a portion of the vacuum enclosure 22 or outer housing 21 via the adjustment screws 118, the conduit 220 houses at least a portion of the first section 108A of the high voltage cable assembly 102 and the cavity 112. The conduit 220 extends along the bottom surface 216A of the clamp body 216 from the circumferential edge of the clamp body to near the center of the bottom surface where it joins with a cylindrical volume 222A. A low-profile plunger/spring assembly 226 is disposed within the cylindrical volume 222A and comprises a plunger 228 and a means for providing a compressive force to the plunger, here comprising a spring 230. One or more calibration windows 238 are defined in the clamp body 216 to enable inspection and calibration or adjustment of the plunger/spring assembly 226 within the cylindrical volume 222A.

The plunger/spring assembly 226 is disposed within the cylindrical volume 222A such that one end of the plunger 228 is disposed adjacent the top inner surface of the clamp while the other end abuts an end of the spring 230. The spring 230 may be coiled, or may comprise a plurality of Belleville spring washers, such as is seen in FIG. 10, where five spring washers stacked back-to-back preferably comprise the spring 230. The spring 230 is at least partially disposed within the cavity 112 of the high voltage cable assembly 102, but may also be partially disposed within the cylindrical volume 222A, depending upon the adjusted distance between the top inner surface of the clamp body 216 and the bottom of the cavity 112. The cavity 112, as in previous embodiments, is configured to receive a compressive force from the plunger/spring assembly 226 and transfer it to the second section 108B of the high voltage cable assembly 102.

Figure 12B:
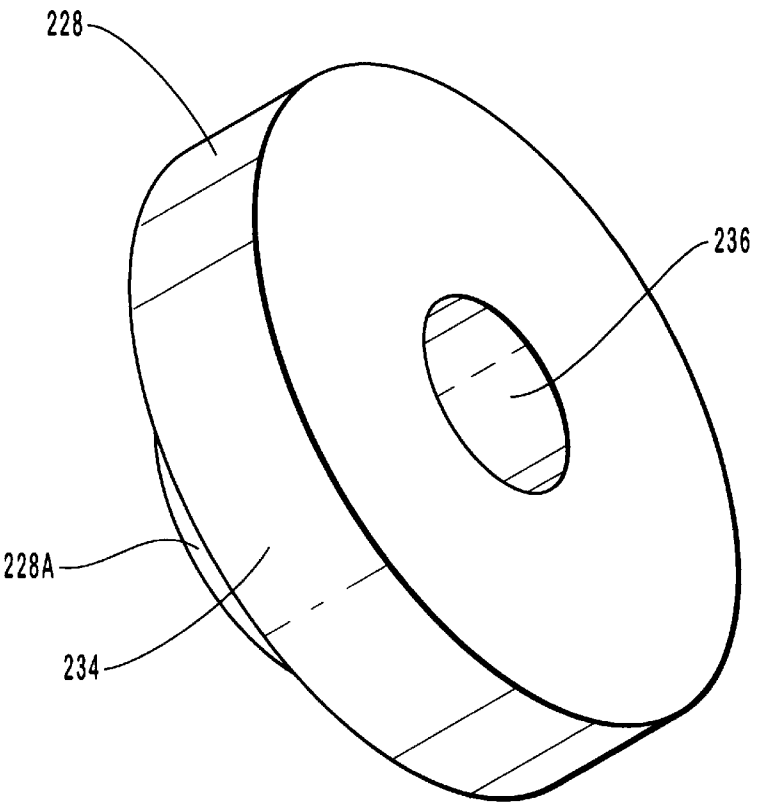
FIG. 12B is another perspective view of the plunger of FIG. 10.
Figure 12A:
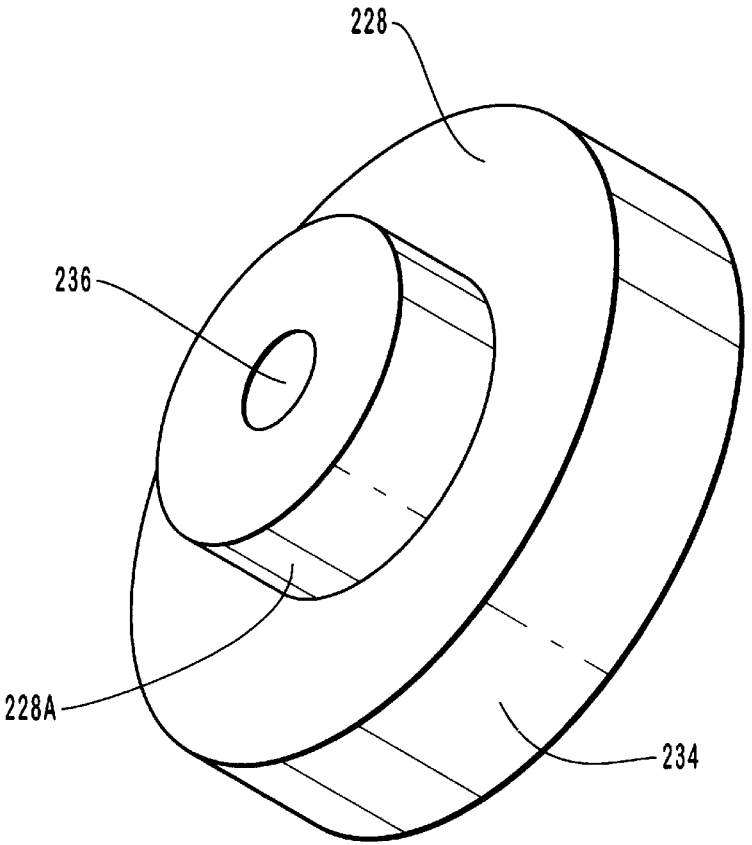
FIG. 12A is a perspective view of the plunger of FIG. 10.

In FIGS. 12A and 12B, the plunger 228 of the plunger/spring assembly 226 of the third embodiment is shown. The plunger 228 comprises an annular body 234 having a central bore 236 through which a retention screw 232 is disposed as part of the plunger/spring assembly 226. On one side of the plunger 228, the central portion is raised to form an annular disk 238. The raised annular disk 238 supports the retention screw 232 disposed within the bore 236 of the plunger 228. The spring 230 is at least partially disposed about the periphery of the raised annular disk 228A, when the spring and the plunger 228 are disposed in the cylindrical volume 222A.

During operation of an x-ray tube 20 fitted with the third embodiment of the high voltage cable and clamp system 100, the high voltage cable assembly 102 is maintained in position via the clamp assembly 104 similar to previous embodiments. When the high voltage cable assembly 102 heats up, the spring 230 of the plunger/spring assembly 226 contracts to accommodate the dimensional expansion of the cable assembly. Similarly, upon cooling of the high voltage cable assembly 102, the spring 230 expands, thereby maintaining sufficient compressive force upon the cable assembly so as to keep it in close physical contact with the inner surface 56 of the cathode insulator 50.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A system for securing a high-voltage cable to an x-ray tube, the system comprising:

a high-voltage cable comprising one or more conductive wires covered by an outer covering; and a clamp assembly at least partially enclosing the high-voltage cable, comprising:

a clamp body secured to the x-ray tube; and means for providing a compressive force to at least a portion of the cable.

2. A system for securing a high voltage cable as defined in claim 1, wherein the means for providing a compressive force comprises a spring and a plunger, wherein at least a portion of the plunger is at least partially disposed within a cavity formed within the outer covering.

3. A system for securing a high voltage cable as defined in claim 1, wherein the means for providing a compressive force comprises a spring disposed within the clamp body so as to exert the compressive force to at least a portion of the cable.

4. A system for securing a high voltage cable as defined in claim 1, wherein the means for providing a compressive force comprises a plurality of Belleville spring washers in a stacked configuration within the clamp body so as to exert the compressive force to at least a portion of the cable.

5. A system for securing a high voltage cable as defined in claim 1, wherein the compressive force is directed approximately along a longitudinal axis of the high-voltage cable.

6. A system for securing a high voltage cable as defined in claim 1, wherein at least a portion of the high voltage cable is disposed along a cathode insulator portion of the x-ray tube.

7. A system for securing a high voltage cable as defined in claim 1, wherein a first section of the high voltage cable is angled with respect to a second section of the high voltage cable.

8. An x-ray tube comprising:

a housing having disposed therein:

an electron emitting cathode;

an anode for receiving electrons emitted by the cathode; and a cathode insulating structure;

a high-voltage cable for supplying electric power to the cathode, wherein at least a portion of the cable is disposed substantially proximate to the cathode insulating structure;

a clamp body enclosing at least a portion of the high-voltage cable, the clamp body being affixed to the housing; and means for exerting a force in a manner so as to maintain the cable in physical contact with at least a portion of the cathode insulating structure.

9. An x-ray tube as defined in claim 8, wherein the force is exerted via a plunger, which is at least partially received within an outer covering of the cable.

10. An x-ray tube as defined in claim 8, wherein the means for exerting a force comprises a spring.

11. An x-ray tube as defined in claim 8, wherein the means for exerting a force comprises a plurality of Belleville spring washers.

12. An x-ray tube as defined in claim 9, wherein the clamp body further comprises a window for visually inspecting the plunger.

13. An x-ray tube as defined in claim 8, wherein the clamp body is affixed to the housing with at least a plurality of adjustment screws.

14. An x-ray tube as defined in claim 13, wherein each of the plurality of adjustment screws is selectively movable for adjusting the distance between the clamp body and the housing.

15. An x-ray tube as defined in claim 8, wherein the cathode insulating structure is shaped so as to cooperatively engage at least a portion of the cable.

16. An x-ray tube as defined in claim 15, wherein the shape is substantially conical.

17. An x-ray tube having an anode, a cathode, and a cathode insulating structure having an inner surface, the x-ray tube further comprising:

a high-voltage cable comprising conductive wires and a plug connector for electrically connecting the conductive wires to the cathode, wherein at least a portion of the cable is configured to cooperatively engage the inner surface of the cathode insulating structure when connected to the cathode;

a cable clamp affixed to a portion of the x-ray tube and enclosing at least the portion of cable;

a spring assembly at least partially disposed within the clamp body and oriented so as to urge a portion of the cable in said cooperative engagement with the inner surface of the cathode insulating structure; and a window defined in the clamp body for visually determining the position of the spring assembly within the clamp body.

18. An x-ray tube as defined in claim 17, wherein the spring assembly includes at least one spring and at least one plunger.

19. An x-ray tube as defined in claim 18, wherein the at least one spring comprises a plurality of Belleville-type spring washers disposed in a stacked configuration.

20. An x-ray tube as defined in claim 18, wherein the at least one plunger comprises a substantially solid cylinder capable of being at least partially received within a cylindrical cavity formed within an outer surface of the cable.

21. An x-ray tube as defined in claim 17, wherein the spring assembly further comprises a retention screw that passes through the at least a portion of the spring assembly and the clamp body.

22. An x-ray tube as defined in claim 17, wherein a cylindrical cavity is defined in a portion of the cable so as to operatively receive an end of the spring assembly.

23. An x-ray tube as defined in claim 22, wherein the clamp body is adjustably affixed to a portion of the x-ray tube via a plurality of adjustment screws.

24. An x-ray tube as defined in claim 17, wherein the window defined in the clamp body includes indicators of the amount of compressive force imparted by the spring assembly on the cable.

25. In an x-ray tube comprising a high voltage cable having an outer covering bent at a right angle, and having one end disposed proximate an inner surface of a cathode insulating structure, a method for maintaining the high voltage cable in physical contact with the inner surface of the cathode insulating structure, the method comprising the steps of:

defining a cylindrical cavity in the high voltage cable near the vertex of the right angle defined by the high voltage cable;

applying a resiliently compressive force to the portion of the high voltage cable surrounding the cavity such that physical contact is maintained between the high voltage cable and the cathode insulating structure.

26. The method for maintaining as defined in claim 25, further comprising the step of:

adjusting the amount of the resiliently compressive force applied to the portion of the high voltage cable surrounding the cavity in response to an indication of the amount of compressive force present on the portion of the high voltage cable surrounding the cavity.

* * * * *